US010162296B2

(12) United States Patent
Moriya et al.

(10) Patent No.: US 10,162,296 B2
(45) Date of Patent: Dec. 25, 2018

(54) TRANSPORT MONITORING CONTROL DEVICE AND IMAGE FORMING APPARATUS

(71) Applicant: FUJI XEROX CO., LTD., Tokyo (JP)

(72) Inventors: Hideki Moriya, Kanagawa (JP); Hidehiko Yamaguchi, Kanagawa (JP); Kozo Tagawa, Kanagawa (JP); Tsuyoshi Sunohara, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 21 days.

(21) Appl. No.: 15/464,598

(22) Filed: Mar. 21, 2017

(65) Prior Publication Data

US 2018/0046124 A1 Feb. 15, 2018

(30) Foreign Application Priority Data

Aug. 10, 2016 (JP) ..... 2016-157980

(51) Int. Cl.
*G03G 15/00* (2006.01)
*B65H 1/00* (2006.01)

(52) U.S. Cl.
CPC ..... *G03G 15/5054* (2013.01); *B65H 1/00* (2013.01); *G03G 15/55* (2013.01); *G03G 15/703* (2013.01)

(58) Field of Classification Search
CPC .... B65H 2511/524; B65H 7/125; B65H 7/12; B65H 5/06–5/068; B65H 2220/03
See application file for complete search history.

(56) References Cited

U.S. PATENT DOCUMENTS 5,443,248 A * 8/1995 Hayashi ..... B42C 1/125 270/58.09
7,583,413 B2 * 9/2009 Nojiri ..... B41J 11/009 358/3.24
7,817,957 B2 * 10/2010 Oohara ..... B65H 7/12 271/258.01
2004/0070142 A1 * 4/2004 Kawasaki ..... B65H 7/12 271/262

(Continued)

FOREIGN PATENT DOCUMENTS

JP 6-032496 A 2/1994
JP 2013-182175 A 9/2013
JP 2014196194 A * 10/2014

*Primary Examiner* — Sevan A Aydin
(74) *Attorney, Agent, or Firm* — Sughrue Mion, PLLC

(57) ABSTRACT

A transport monitoring control device includes a pair of rollers configured to transport a recording medium while nipping the recording medium therebetween, the pair of rollers having circumferential surfaces coming in contact with the recording medium, the circumferential surfaces being different from each other in hardness, a driving unit configured to drive the pair of rollers, a detector configured to detect waveforms related to a load of the driving unit, an extractor configured to extract a peak waveform having an extreme point temporarily exceeding a predetermined threshold value, from among the waveforms detected by the detector, and a determining unit configured to determine whether multi-feed of the recording medium is present, based on the number of peak waveforms extracted by the extractor.

10 Claims, 14 Drawing Sheets

(56) References Cited

U.S. PATENT DOCUMENTS

| | | | | |
|---|---|---|---|---|
| 2005/0040587 | A1* | 2/2005 | Kawasaki | B65H 7/12 271/100 |
| 2007/0023996 | A1* | 2/2007 | Kawasaki | B65H 7/12 271/262 |
| 2008/0303206 | A1* | 12/2008 | Ohshima | B65H 7/12 271/262 |
| 2015/0274465 | A1* | 10/2015 | Takahashi | B65H 5/062 271/265.04 |
| 2015/0336757 | A1* | 11/2015 | Kumagai | B65H 7/12 271/265.01 |
| 2016/0114994 | A1* | 4/2016 | Fukusaka | G03G 15/703 271/3.15 |

* cited by examiner

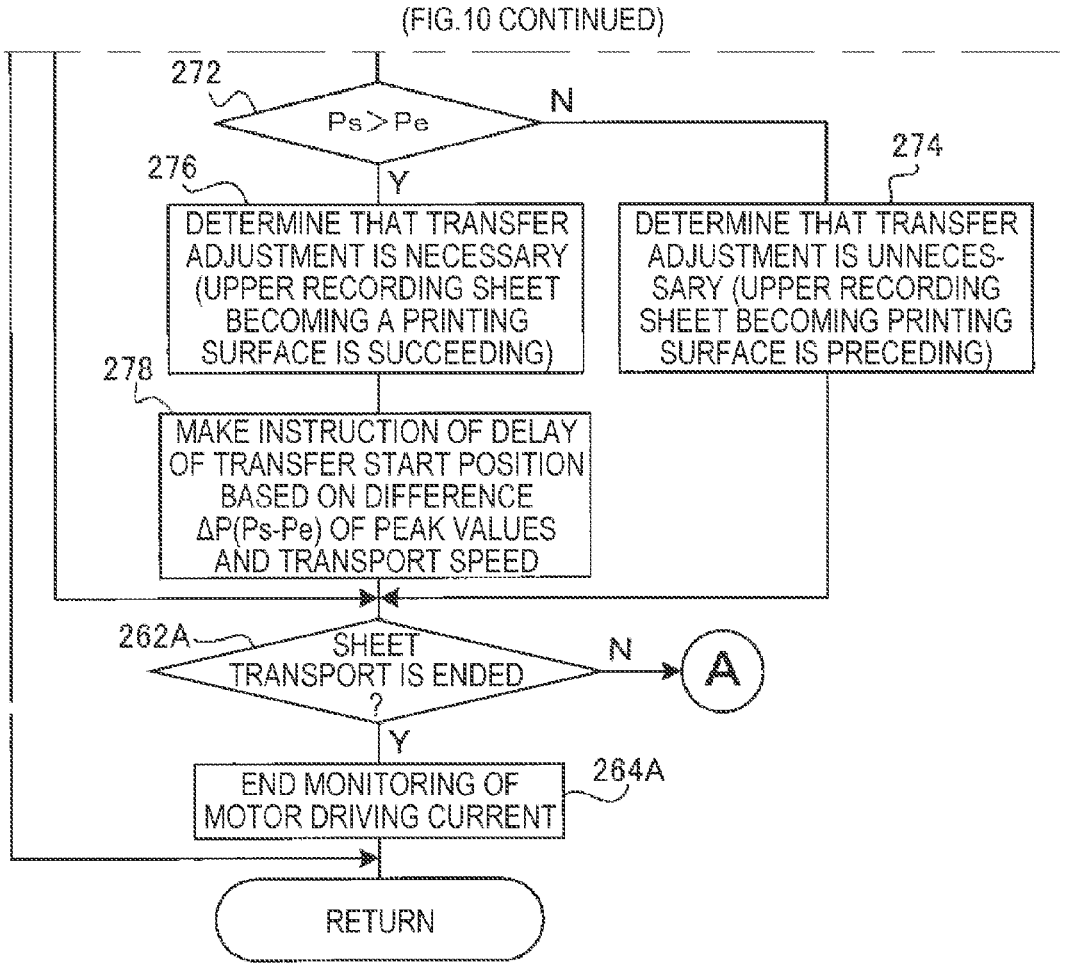
FIG.11A
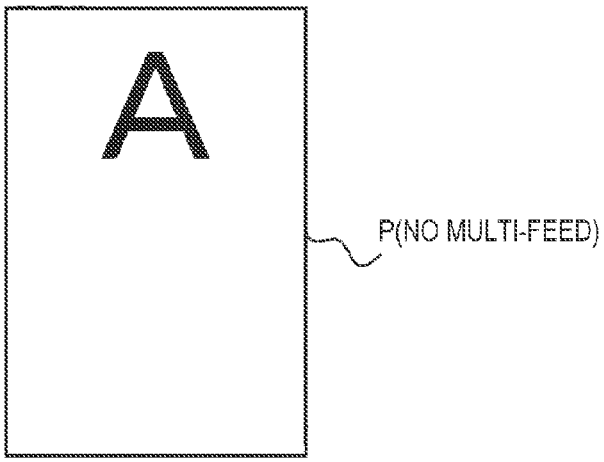

TRANSPORT MONITORING CONTROL DEVICE AND IMAGE FORMING APPARATUS

CROSS-REFERENCE TO RELATED APPLICATIONS

This application is based on and claims priority under 35 USC 119 from Japanese Patent Application No. 2016-157980 filed Aug. 10, 2016.

BACKGROUND

Technical Field

The present invention relates to a transport monitoring control device and an image forming apparatus.

SUMMARY

According to an aspect of the invention, a transport monitoring control device includes a pair of rollers configured to transport a recording medium while nipping the recording medium therebetween, the pair of rollers having circumferential surfaces coming in contact with the recording medium, the circumferential surfaces being different from each other in hardness, a driving unit configured to drive the pair of rollers, a detector configured to detect waveforms related to a load of the driving unit, an extractor configured to extract a peak waveform having an extreme point temporarily exceeding a predetermined threshold value, from among the waveforms detected by the detector, and a determining unit configured to determine whether multi-feed of the recording medium is present, based on the number of peak waveforms extracted by the extractor.

BRIEF DESCRIPTION OF THE DRAWINGS

Exemplary embodiments of the present invention will be described in detail based on the following figures, wherein:

FIG. 11A is a plan view illustrating an image transfer state on a recording sheet in a case where no multi-feed is present, according to the second exemplary embodiment;

DETAILED DESCRIPTION (First Exemplary Embodiment)

Figure 1:
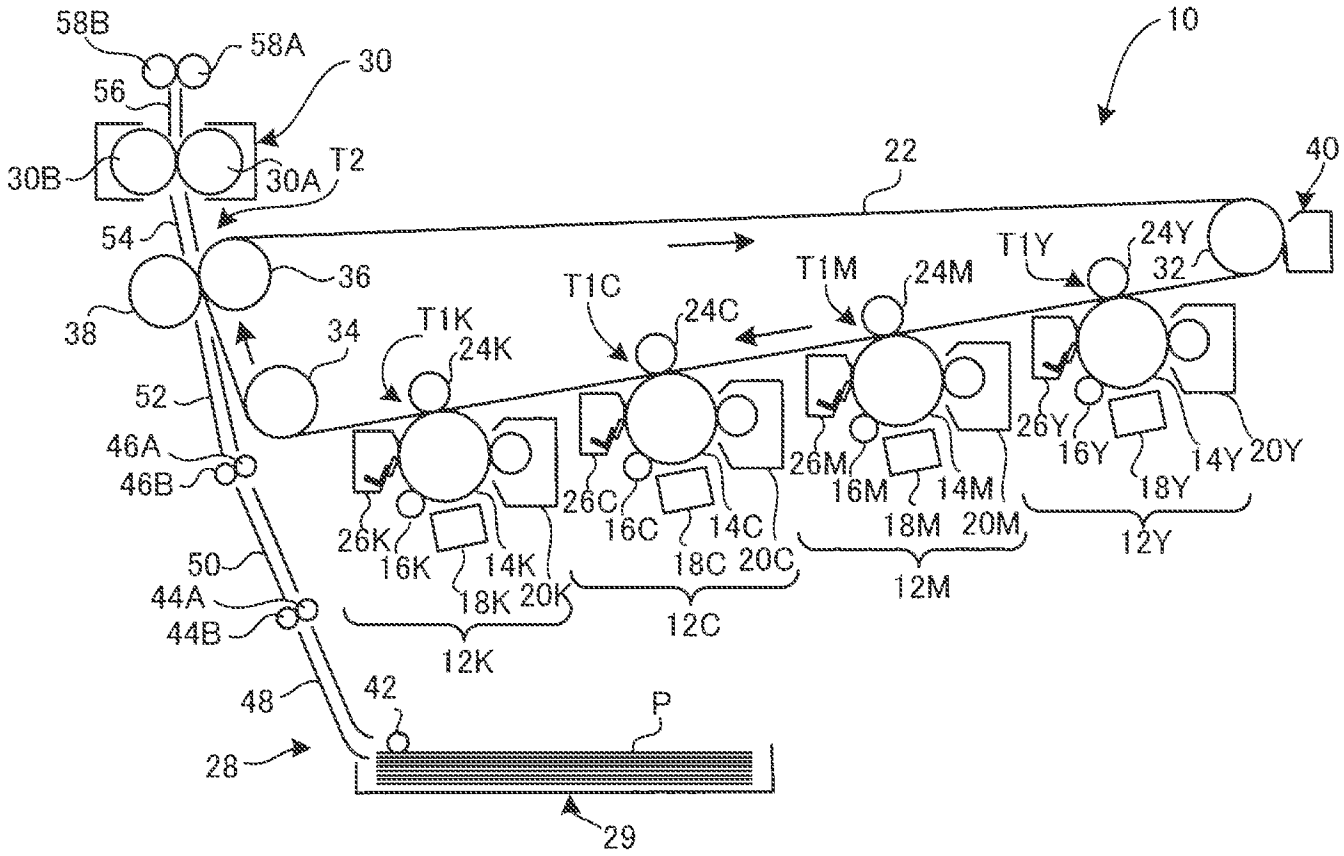
FIG. 1 is a front view illustrating an image forming apparatus according to a first exemplary embodiment.

FIG. 1 is a schematic configuration view illustrating an image forming apparatus 10 according to a first exemplary embodiment.

The image forming apparatus 10 is capable of forming an image in full-color using a quadruple tandem system (image forming may be referred to as "printing"), in which first to fourth electrophotaphic image forming units 12Y, 12M, 12C, and 12K, each of which is an example of an image forming unit, are arranged at predetermined intervals in this order from the upstream side to output images of colors of yellow (Y), magenta (M), cyan (C), and black (K).

Hereinafter, the first image forming unit 12Y, the second image forming unit 12M, the third image forming unit 120, and the fourth image forming unit 12K in the quadruple tandem have the same configurations, and thus may be collectively referred to as "image forming units 12." When the respective components of the image forming units 12 are not distinguished in description, the ends ("Y," "M," "C," and "K") of reference numerals of the respective components described in the drawings may be omitted.

Each image forming unit 12 includes a drum-type photoconductor drum 14 having a photoconductive layer on the surface thereof, a charging roller 16 configured to uniformly charge the photoconductor drum 14, an exposure unit 18 configured to emit an image light to the uniformly charged photoconductor drum 14 to form an electrostatic latent image, a developing unit 20 configured to transfer a toner to the latent image to form a toner image, and a cleaning unit 26 configured to remove a toner remaining on the photoconductor drum 14 after the transfer.

The image forming apparatus 10 includes an intermediate transfer belt 22 having an endless belt shape and serving as an image carrier, which is stretched to circulate through a path coming in contact with the photoconductor drum 14 of each of the image forming units 12 in the quadruple tandem, and a primary transfer roller 24 which transfers the toner image formed on the photoconductor drum 14 to the intermediate transfer belt 22. An area where the photoconductor drum 14 faces the primary transfer roller 24 is referred to as a primary transfer section T1.

The image forming apparatus 10 includes a recording sheet transport mechanism 28 as an example of a transport unit, configured to transport a recording sheet P accommodated in a sheet tray 29, and a fixing unit 30 configured to fix the toner image on the recording sheet P.

The fixing unit 30 includes a heating roller 30A and a pressure roller 30B driven by a driving force of a fixing motor 200 (see e.g., FIG. 3) as a driving unit.

The intermediate transfer belt 22 is wound around a drive roller 32 rotationally driven by a transfer motor 202 (see, e.g., FIG. 3) as a driving unit, a tension roller 34 configured to adjust tension, and a backup roller 36 as an opposing member. The primary transfer roller 24 is disposed inside the intermediate transfer belt 22.

A secondary transfer roller 38 is provided at a position facing the backup roller 36 across the intermediate transfer belt 22. The secondary transfer roller 38 serves as a transfer member that transfers the toner image on the intermediate transfer belt 22 to the recording sheet P transported by the recording sheet transport mechanism 28. An area where the backup roller 36 faces the secondary transfer roller 38 is referred to as a secondary transfer section T2.

A toner remover 40 is provided at a position facing the drive roller 32 across the intermediate transfer belt 22. The toner remover 40 is configured to remove a toner remaining on the intermediate transfer belt 22 after the toner image is transferred to the recording sheet P by the secondary transfer roller 38.

The recording sheet transport mechanism 28 includes a pickup roller 42 configured to take out the uppermost recording sheet P accommodated in the sheet tray 29, feed rollers 44A and 44B driven by a driving force of a feed motor 204 (see, e.g., FIG. 3) as a driving unit and configured to feed the taken-out recording sheet P to the secondary transfer section T2, registration rollers 46A and 46B driven by a driving force of a registration motor 206 (see, e.g., FIG. 3) as a driving unit, and configured to determine a relative position between the image on the intermediate transfer belt 22 and the recording sheet P, paper guides 48, 50, 52, 54 and 56 configured to guide a transport path, sheet discharge rollers 58A and 58B driven by a driving force of a sheet discharge motor 208 (see, e.g., FIG. 3) as a driving unit, an output tray (not illustrated), and the like.

In FIG. 1, one stage of sheet tray 29 is illustrated. However, when plural stages of sheet trays 29 are present, pickup rollers and transport rollers are added according to the number of stages.

Although not illustrated, a reversing mechanism capable of executing duplex printing may be provided in which the sheet discharge rollers 58A and 58B are rotationally driven in a reverse direction to reverse the front and back surfaces of the recording sheet P, and the recording sheet P is returned to the upstream side of the registration rollers 46A and 46B.

The recording sheet transport mechanism 28 transports the recording sheet P accommodated in the sheet tray 29 to the secondary transfer section T2 where the secondary transfer roller 38 and the backup roller 36 face each other across the intermediate transfer belt 22, transports the recording sheet P from the secondary transfer section T2 to the fixing unit 30, and then transports the recording sheet P from the fixing unit 30 to an output tray.

(Engine Unit Control System)

Figure 2:
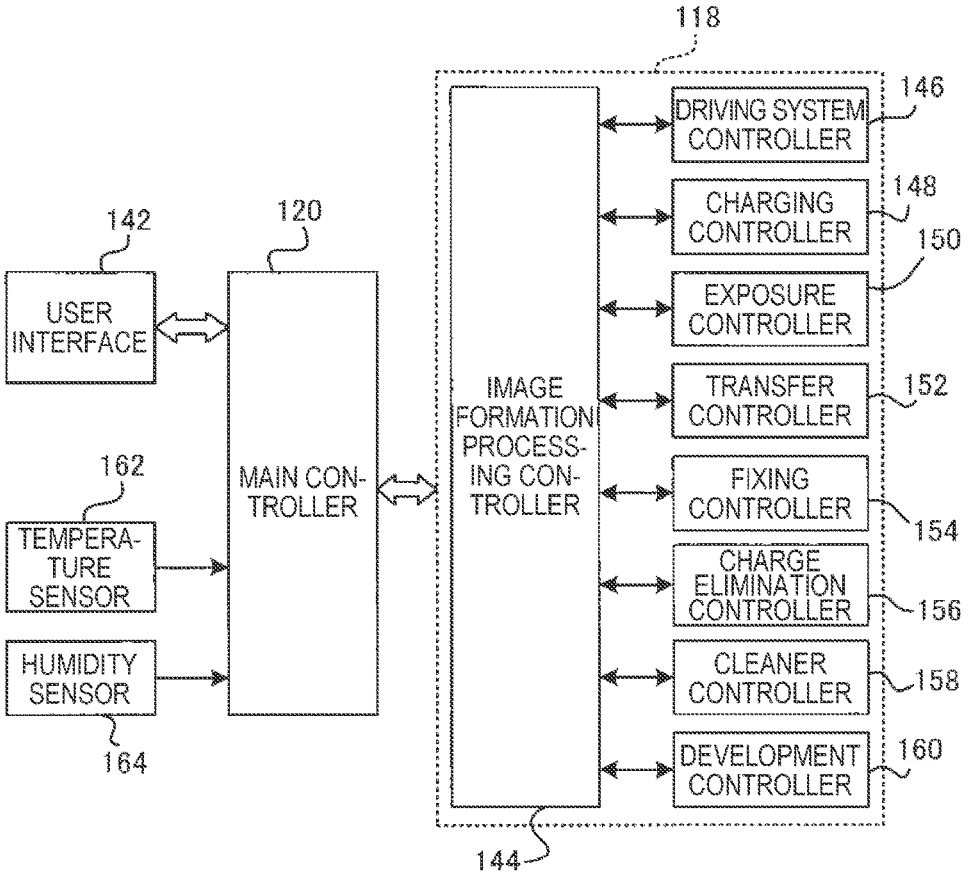
FIG. 2 is a control block diagram illustrating an image formation processing engine of the image forming apparatus according to the first exemplary embodiment.

FIG. 2 is a block diagram illustrating an example of a control system of the image forming apparatus 10.

A main controller 120 as a main control function of the image forming apparatus 10 is connected to a user interface 142. The user interface 142 includes an input unit through which an instruction related to image formation or the like is input, and an output unit through which information such. as image formation or the like is notified by display or voice.

The main controller 120 is connected to a communication network with an external host computer (not illustrated), and image data is input to the main controller 120 through the communication network.

When image data is input, the main controller 120 analyzes, for example, print instruction information and images included in the image data, converts the image data into data with a format suitable for the image forming apparatus 10 (e.g., raster image data), and sends the converted image data to an image formation processing controller 144 serving as a part of an MCU 118.

Based on the input image data, the image formation processing controller 144 synchronously controls each of a driving system controller 146, a charging controller 148, an exposure controller 150, a transfer controller 152, a fixing controller 154, a charge elimination controller 156, a cleaner controller 158, and a development controller 160, each of which serves as an MCU 118, together with the image formation processing controller 141, and executes image formation. In FIG. 2, functions executed by the MCU 118 are classified into blocks and illustrated, and the hardware configuration of the MCU 118 is not limited thereto.

Further, the main controller 120 is connected to a temperature sensor 162, a humidity sensor 164, and the like, and may detect the ambient temperature and humidity within the housing of the image forming apparatus 10 based on the temperature sensor 162 and the humidity sensor 164.

Figure 3:
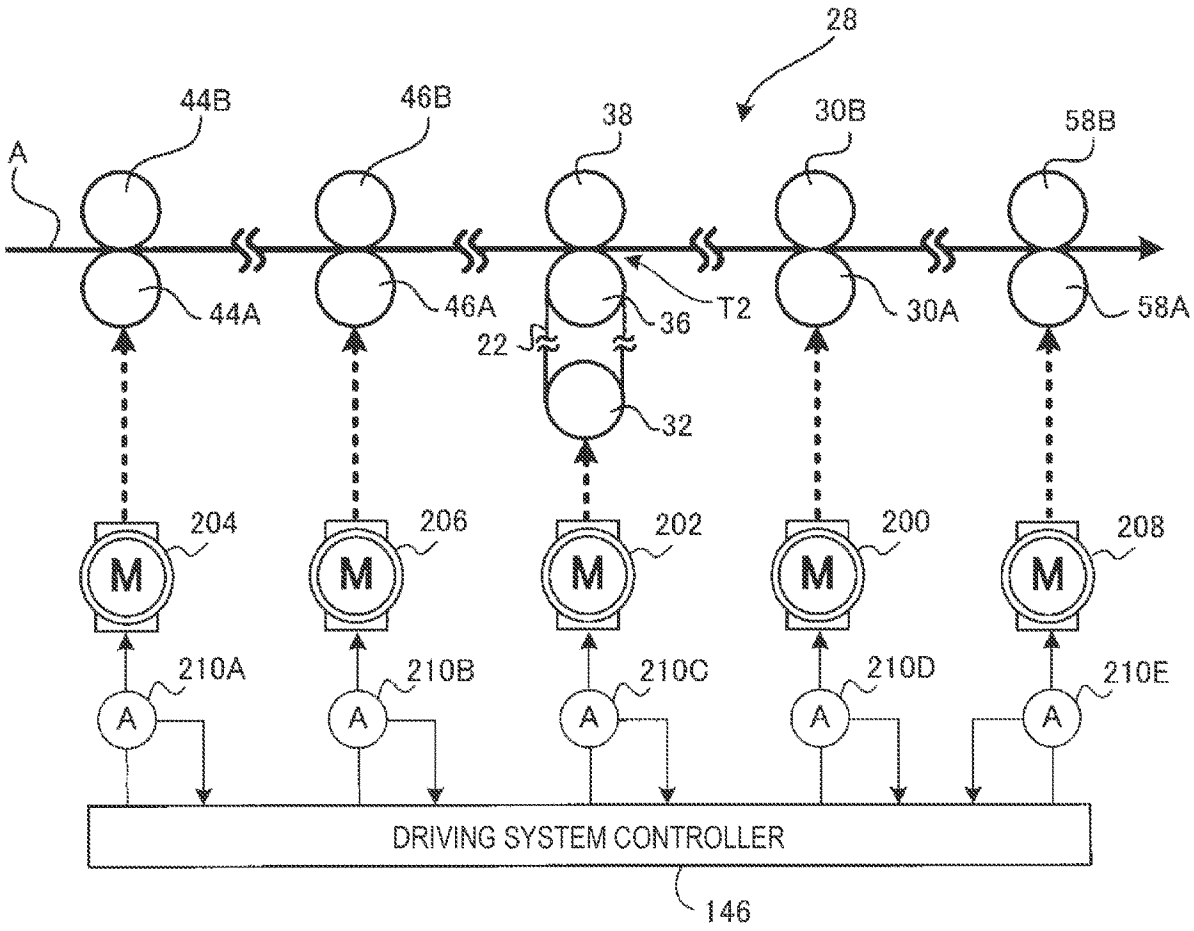
FIG. 3 is a front view equivalently illustrating a relative positional relationship between portions applying a transport force to a recording sheet in a recording sheet transport mechanism of the image forming apparatus in FIG. 1, according to the first exemplary embodiment.

FIG. 3 is a front view of a transport system equivalently illustrating a relative positional relationship between portions (the feed rollers 44, the registration rollers 46, the intermediate transfer belt 22, the fixing unit 30, and the sheet discharge rollers 58) provided along the recording sheet transport mechanism 28 and applying a transport force to the recording sheet P.

The driving system controller 146 controls the driving of driving sources including the feed motor 204, the registration motor 206, the transfer motor 202, the fixing motor 200, and the sheet discharge motor 208.

A transport force is imparted to the recording sheet P from the feed rollers 44, the registration rollers 46, the intermediate transfer belt 22, the fixing unit 30, and the sheet discharge rollers 58 in this order from the left side in the transport path indicated by the arrow A in FIG. 3.

In addition, in the secondary transfer section T2, the transport force is imparted to the recording sheet P as the recording sheet P is nipped between the intermediate transfer belt 22 operated by a driving force of the drive roller 32 and the secondary transfer roller 38. In addition, in the fixing unit 30, the transport force is imparted to the recording sheet P as the recording sheet P is nipped between the heating roller 30A and the pressure roller 30B.

Current detectors 210A to 210E are selectively interposed in power supply lines for driving the feed motor 204, the registration motor 206, the transfer motor 202, the fixing motor 200, and the sheet discharge motor 208. In the following specification, the current detectors 210A to 210E may be collectively referred to as a current detector 210.

The current detector 210 is a device used for monitoring (detecting) multi-feed in which two or more recording sheets P are transported in an overlapping state as described below.

In the first exemplary embodiment, multi-feed in the sheet transport path from the sheet tray 29 to the sheet discharge rollers 58A and 58B may be monitored (detected) and notified even by the current detector 210 provided at least at one place. The term "selectively" means that the attachment position of the current detector 210 is properly selected.

That is, in FIG. 3, the current detectors 210 are attached to all power supply lines for driving the feed motor 204, the registration motor 206, the transfer motor 202, the fixing motor 200, and the sheet discharge motor 208, but the attachment places and the number of the current detectors 210 are not limited.

As described below, when the current is detected by the current detector 210A of the feed rollers 44A and 44B or the current detector 210B of the registration rollers 46A and 46B, it is possible not only to notify of an occurrence of multi-feed, but also to adjust the deviation of an image formation position on the recording sheet P which is caused by the multi-feed.

The current value detected by the current detector 210 is output to the driving system controller 146.

Here, basic functions of respective portions illustrated in FIG. 3 in the transport of the recording sheet P are the same.

Figure 4A:
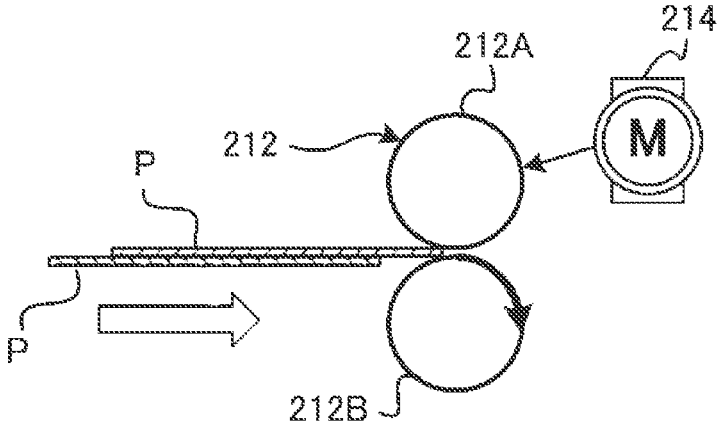
FIG. 4A is a front view illustrating a timing when a preceding recording sheet has reached a pair of rollers during multi-feed, according to the first exemplary embodiment.
Figure 4B:
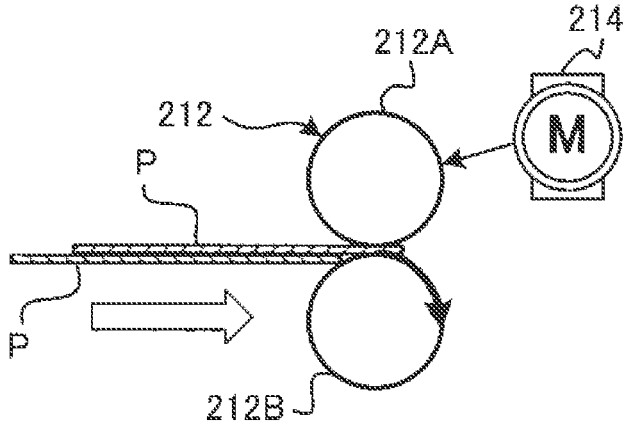
FIG. 4B is a front view illustrating a timing when a succeeding recording sheet has reached the pair of rollers during multi-feed, according to the first exemplary embodiment.

As illustrated in FIGS. 4A and 4B, in each of the portions, when the recording sheet P is nipped by a pair of rollers 212, one serves as a driving roller 212A driven by a driving force of a motor 214, and the other serves as a follower roller 212B. The pair of rollers 212 impart a transport force to the recording sheet P by nipping the recording sheet P therebetween.

That is, the driving roller 212A corresponds to the feed roller 44A, the registration roller 46A, the intermediate transfer belt 22, the heating roller 30A, and the sheet discharge roller 58A in FIGS. 1 and 3, and the follower roller 212B corresponds to the feed roller 44B, the registration roller 46B, the secondary transfer roller 38, the pressure roller 30B, and the sheet discharge roller 58B in FIGS. 1 and 3.

The motor 214 corresponds to the feed motor 204, the registration motor 206, the transfer motor 202, the fixing motor 200, and the sheet discharge motor 208 which are driven and controlled by the driving system controller 146 (see, e.g., FIG. 3).

Hereinafter, portions in the recording sheet transport mechanism 28 which impart a transport force to the recording sheet P may be collectively referred to as the pair of rollers 212 (the driving roller 212A and the follower roller 212B) and the motor 214 based on FIGS. 4A and 4B without being distinguished.

(Motor Load Principle and Multi-Feed Monitoring)

FIGS. 4A and 4B illustrate a state where multi-feed has occurred (here, two recording sheets P in an overlapping state are transported) when the recording sheet P is nipped by the pair of rollers 212.

Figure 4C:
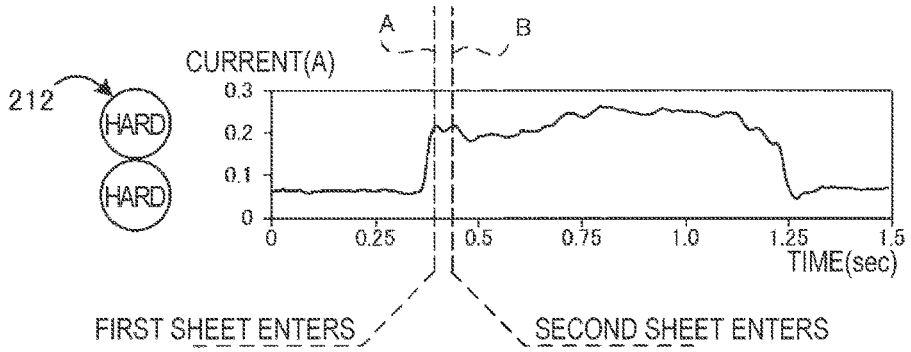
FIG. 4C is a current characteristic diagram during multi-feed transport in a case where both the pair of rollers are made of hard materials, according to the first exemplary embodiment.
Figure 4D:
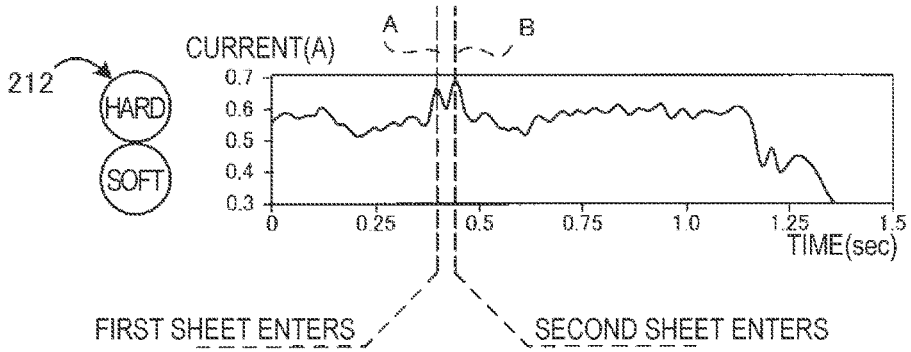
FIG. 4D is a current characteristic diagram during multi-feed transport in a case where the pair of rollers are made of a combination of hard and soft materials, according to the first exemplary embodiment.

FIG. 4A illustrates a timing when a preceding recording sheet P has reached the pair of rollers 212 (see, e.g., the chain line A in FIGS. 4C and 4D).

FIG. 4B illustrates a timing when a recording sheet P multi-fed subsequently to the preceding recording sheet P has reached the pair of rollers 212 (see, e.g., the chain line B in FIGS. 4C and 4D).

In any of states in FIGS. 4A and 4B, a load is applied to the motor 214 when the recording sheet P is pinched by the pair of rollers 212.

FIG. 4C illustrates a motor current transition diagram in a case where surface materials of the pair of rollers 212 are metallic or plastic, and are higher in the hardness than a rubber or foamed synthetic resin (in a case of hard rollers).

That is, when the recording sheet P is transported, it is possible to monitor the presence or absence of multi-feed based on whether two consecutive waveforms (hereinafter, referred to as "peak waveforms") each having a local maximum value (a current peak value exceeding a predetermined threshold value) are present in the driving current of the motor 214.

Here, in the first exemplary embodiment, the surfaces of the pair of rollers 212 are made of materials that are different from each other in hardness. It has been found that the peak waveforms are waveforms indicating a change in the thickness when the leading end of the recording sheet P is nipped and that the peak waveforms depend on a rotational resistance force of a relatively soft roller.

FIG. 4D illustrates a motor current transition diagram in a case where one of the pair of rollers 212 is a hard roller having a surface made of a metallic or plastic material, and the other is a soft roller having a lower hardness than the hard roller, which has a surface made of a rubber or foamed synthetic resin.

It can be found that in the motor current transition diagram in FIG. 4D, an occurrence or the peak waveform becomes noticeable as compared to that in the motor current transition diagram of FIG. 4C.

Therefore, in the first exemplary embodiment, at least one of roller pairs of respective portions ("the feed rollers 44A and 44B," "the registration rollers 46A and 46B," "the backup roller 36 and the secondary transfer roller 38," "the heating roller 30A and the pressure roller 30B," "the sheet discharge rollers 58A and 58B") to be applied as the pair of rollers 212 is selected, and the rollers of the selected pair are made to be different in hardness.

The current detector 210 is selectively attached to at least one of motors of respective portions (the feed motor 204, the registration motor 206, the transfer motor 202, the fixing motor 200, and the sheet discharge motor 208) to be applied as the motor 214 for driving the selected pair of rollers 212.

Based on the signal detected from the current detector 210, the driving system controller 146 monitors the presence or absence of multi-feed according to whether two consecutive peak waveforms (waveforms with current peak values exceeding a predetermined threshold value) are present in the driving current of the motor 214 during the transport of the recording sheet P.

Figure 5:
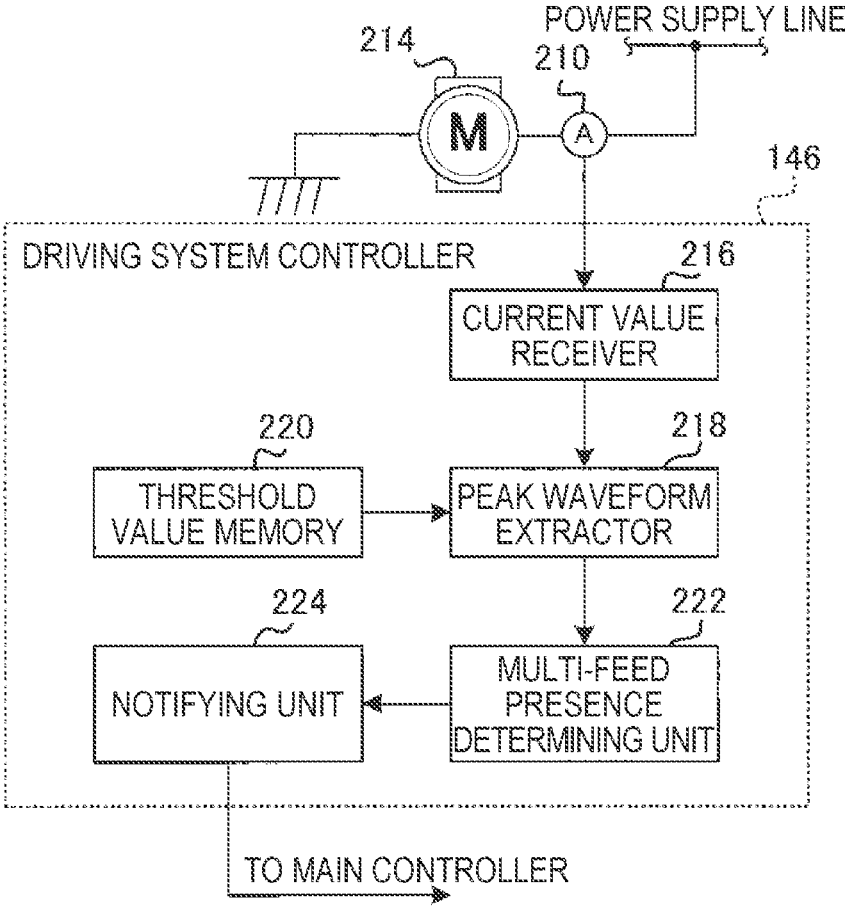
FIG. 5 is a block diagram specialized for a function executed by the driving system controller, that is, a function for executing monitoring of the multi-feed of a recording sheet P, according to the first exemplary embodiment.

FIG. 5 is a block diagram specialized for a function executed by the driving system controller 146, that is, a function for executing the monitoring of the multi-feed of the recording sheet P. The hardware configuration of the driving system controller 146 is not limited to the respective blocks of FIG. 5.

The multi-feed monitoring function may be executed by the image formation processing controller 144 or the main controller 120 illustrated in FIG. 2 regardless of the driving system controller 146. A dedicated control device having multi-feed monitoring function may be newly mounted or connected to the image forming apparatus 10.

As illustrated in FIG. 5, the current detector 210 connected to the power supply line of the selected motor 214 (at least one of the motors illustrated in FIG. 3) is connected to a current value receiver 216.

The current value receiver 216 is connected to a peak waveform extractor 218. The peak waveform extractor 218 is connected to a threshold value memory 220.

The peak waveform extractor 218 specifies an entry current region (a peak waveform) exceeding a threshold value among current values received by the current value receiver 216.

The peak waveform extractor 218 is connected to a multi-feed presence determining unit 222. The multi-feed presence determining unit 222 acquires information related to the peak waveform extracted by the peak waveform extractor 218 (a timing of a peak occurrence, etc.) Based on the information related to the peak waveform, the multi-feed presence determining unit 222 determines whether multi-feed is present according to whether the number of peak waveforms (exceeding the threshold value) is singular or plural.

That is, the number of peak waveforms is one when the number of recording sheets P is one, and the number of peak waveforms is two or more when the number of recording sheets P is two or more. Thus, if there is one peak waveform, the multi-feed presence determining unit 222 determines that multi-feed is not present, and otherwise the multi-feed presence determining unit 222 determines that multi-feed is present.

The result determined by the multi-feed presence determining unit 222 is sent to a notifying unit 224. At least when it is determined that multi-feed is present, the multi-feed presence determining unit 222 notifies the user of the occurrence of the multi-feed. The notification may be typically a notification made through visual sense such as warning display on the user interface 142, or turning-ON of light, or a notification made through auditory sense such as speaker output is representative. Alternatively, the notification may be made through other senses such as the sense of smell, the sense of touch, or the like.

In the first exemplary embodiment, if there is one peak waveform, it is determined that "no multi-feed is present." Alternatively, plural threshold values (plural levels) for extracting a peak waveform. may be set in order to deal with a case where, for example, two or more recording sheets entirely overlaps with each other. When there is a waveform exceeding a threshold value higher than a lowest threshold value, it may be determined that multi-feed is present regardless of the number of peak waveforms.

Hereinafter, the operation of the first exemplary embodiment will be described.

(Flow of Normal Image Formation Processing Mode)

The image forming units 12 have substantially the same configuration. Thus, hereinafter, the first image forming unit 12Y configured to form a yellow image and disposed upstream in the traveling direction of the intermediate transfer belt 22 will be representatively described. By assigning the same reference numerals with magenta (M), cyan (C), and black (K) instead of yellow (Y) to the members having the same function as the first image forming unit 12Y, descriptions on the second to fourth image forming units 12M, 12C, and 12K will be omitted.

First, prior to the operation, the rotation of the photoconductor drum 14Y is initiated. Thereafter, the surface of the photoconductor drum 14Y is applied with superimposed voltage of DC and AC by the charging roller 16Y in the first exemplary embodiment, and is charged to a predetermined potential. In general, the predetermined potential may be selected from a range of from −400 V to −800 V. In order to charge, for example, the photoconductor drum 14Y, a voltage obtained by superimposing an AC voltage with a specific amplitude Vpp and a specific frequency f on a DC voltage is applied to the charging roller 16Y.

The photoconductor drum 14Y is formed so that photosensitive layer is stacked on a conductive metal base body. The photoconductor drum 14Y has a property that the resistance thereof is normally high, but when the photoconductor drum 14Y is irradiated with LED light, the resistance of the portion irradiated with the LED lays is changed.

Therefore, in the MCU 118, a light beam for exposure (e.g., LED light) is output by the exposure unit 18 to the charged surface of the photoconductor drum 14Y according to image data for yellow sent from the main controller 120. The light beam is emitted to the photosensitive layer on the surface of the photoconductor drum 14Y, and thus, an electrostatic latent image with a yellow printing pattern is formed on the surface of the photoconductor drum 14Y.

The electrostatic latent image refers to an image formed on the surface of the photoconductor drum 14Y due to charging, that is, a so-called negative latent image formed when the specific electric resistance of an irradiated portion of the photosensitive layer is lowered by the light beam, and thus electric charges charged on the surface of the photoconductor drum 14Y flow, while electric charges on the portion not irradiated with the light beam remain.

In this manner, the electrostatic latent image formed on the photoconductor drum 14Y is rotated to a developing position due to the rotation of the photoconductor drum 14Y. Then, at the developing position, the electrostatic latent image on the photoconductor drum 14Y is converted into a visible image (toner image) by the developing unit 20Y.

In the developing unit 20Y, a yellow toner produced by an emulsion polymerization method is accommodated. The yellow toner is frictionally electrified by being agitated inside the developing unit 20Y, and has electric charges of the same polarity (−) as the electric charges on the surface of the photoconductor drum 14Y.

As the surface of the photoconductor drum 14Y passes through the developing unit 20Y, the yellow toner electrostatically adheres to only the neutralized latent image portion on the surface of the photoconductor drum 14Y, and the latent image is developed with the yellow toner.

The photoconductor drum 14Y continuously rotates so that the toner image developed on the surface of the photoconductor drum 14Y is transported to the primary transfer section T1. When the yellow toner image on the surface of the photoconductor drum 14Y is transported to the primary transfer section T1, a primary transfer bias is applied to the primary transfer roller 24Y. Then, the electrostatic force directed to the primary transfer roller 24Y from the photoconductor drum 14Y acts on the toner image, and the toner image on the surface of the photoconductor drum 14Y is transferred to the surface of the intermediate transfer belt 22.

Here, the transfer bias to be applied has a (+) polarity opposite to the polarity (−) of the toner, and is controlled to, for example, be a constant current ranging from about +20 to +30 μA by the transfer controller 152 in the first image forming unit 12Y.

Meanwhile, the toner remaining on the surface of the photoconductor drum 14Y after the transfer is cleaned by the cleaning unit 26Y.

The primary transfer bias to be applied to the primary transfer rollers 24M, 24C, and 24K subsequently to the second image forming unit 12M is controlled in the same manner as described above.

In this manner, the intermediate transfer belt 22 transferred with the yellow toner image in the first image forming unit 12Y is sequentially transported through the second to fourth image forming units 12M, 12C, and 12K, and the toner images of respective colors are similarly superimposed and transferred in a superimposed manner.

The intermediate transfer belt 22 on which the toner images of all colors are transferred in the superimposed manner by all the image forming units 12 is circumferentially transported in the arrow direction, and reaches the secondary transfer section T2 that is constituted with the backup roller 36 coming in contact with the inner surface of the intermediate transfer belt 22 and the secondary transfer roller 38 disposed at the image carrying surface side of the intermediate transfer belt 22.

Meanwhile, the recording sheet P is fed to a gap between the secondary transfer roller 38 and the intermediate transfer belt 22 at a predetermined timing by a supply mechanism, and a secondary transfer bias is applied to the secondary transfer roller 38.

Here, the transfer bias to be applied has a (+) polarity opposite to the polarity (−) of the toner, the electrostatic force toward the recording sheet P from the intermediate transfer belt 22 acts on the toner image, and the toner image on the surface of the intermediate transfer belt 22 is transferred to the surface of the recording sheet P.

Thereafter, the recording sheet P is sent to the fixing unit 30 and the toner image is heated and pressurized, so that the color-superimposed toner image is melted and permanently fixed to the surface of the recording sheet P. The recording sheet P on which a color image has been fixed is transported toward a discharge unit, and a series of color image formation operations are completed.

(Multi-Feed Monitoring Control)

Figure 6:
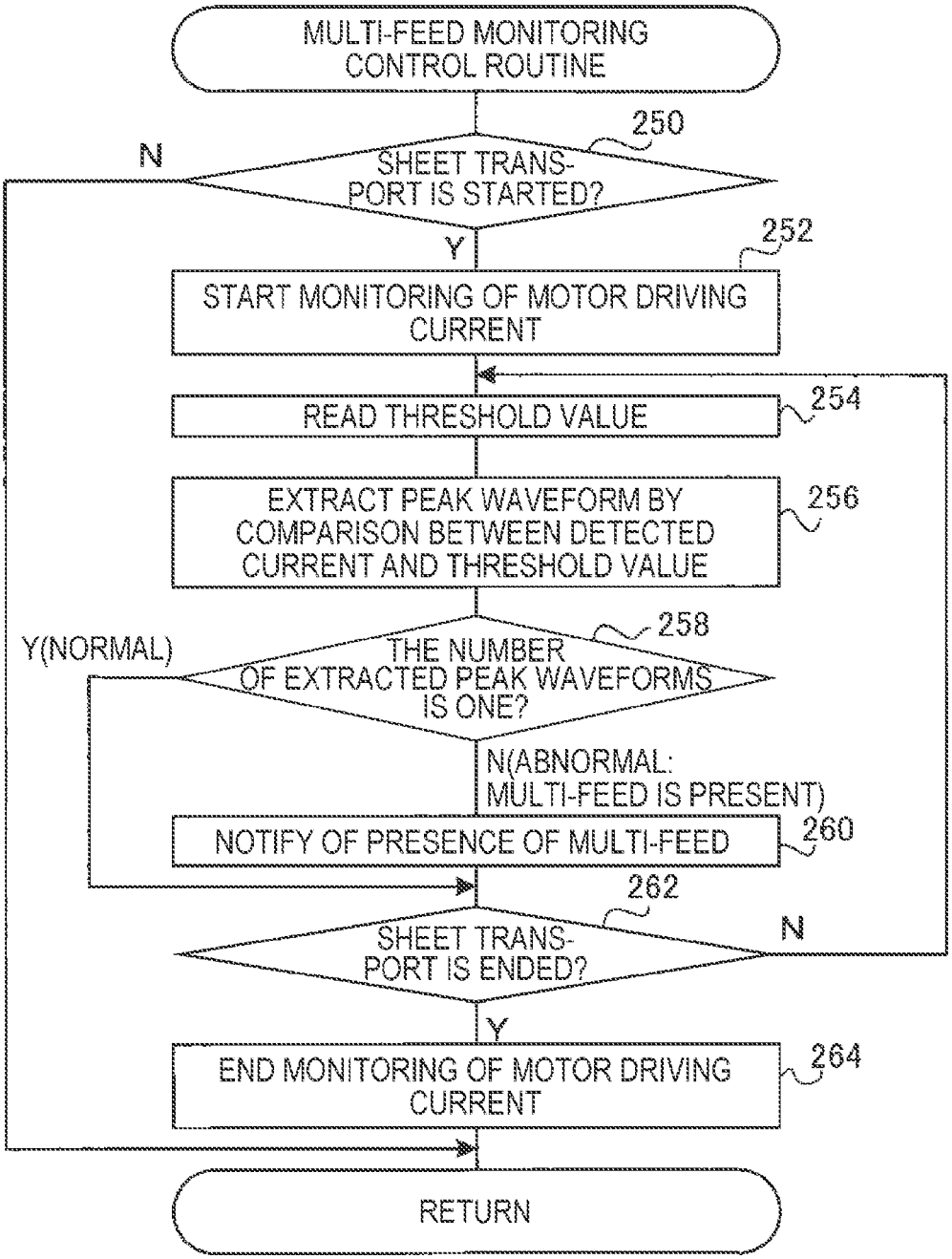
FIG. 6 is a flow chart illustrating a multi-feed monitoring control routine of a recording sheet P, which is executed by the driving system controller, according to the first exemplary embodiment.

FIG. 6 is a flow chart illustrating a multi-feed monitoring control routine of a recording sheet P, which is executed by the driving system controller 146 according to the first exemplary embodiment.

In step 250, it is determined whether the transport of the recording sheet P is started. When a negative determination is made, this routine is ended.

When an affirmative determination is made in step 250, the process proceeds to step 252 to start the monitoring of a motor driving current.

Thereafter, in step 254, a threshold value is read from the threshold value memory 220, and the process proceeds to step 256, in which a peak waveform that is a load current (entry current) when the recording sheet P enters the pair of rollers 212 is extracted by comparing a current value detected by the current detector 210 to the threshold value.

Next, in step 258, at is determined whether the number of peak waveforms extracted in step 256 is one. When an affirmative determination is made, it is determined that no multi-feed (normal) is present, and the process proceeds to step 262.

When a negative determination is made in step 258, it is determined that multi-feed (abnormal) is present, and the process proceeds to step 260. The effect of the multi-feed is notified and the process proceeds to step 262.

In step 262, it is determined whether the transport of the recording sheet P is ended (whether the image formation processing is ended). When a negative determination is made, the process proceeds back to step 254 and the above described steps are repeated.

When an affirmative determination is made in step 262, the process proceeds to step 264. The monitoring of the motor driving current is ended and this routine is ended.

(Second Exemplary Embodiment)

There are two types of multi-feed states.

Figure 7A:
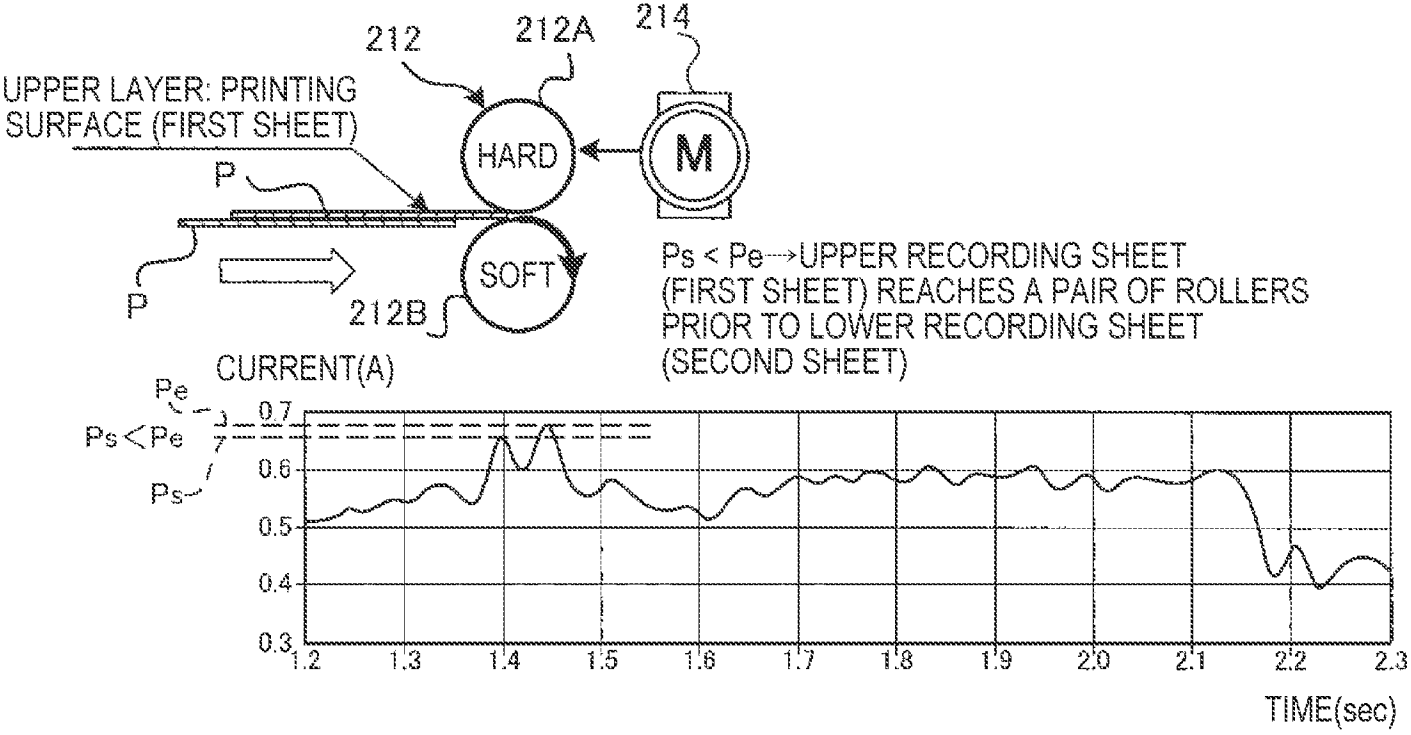
FIG. 7A illustrates a front view and a current characteristic diagram when an upper recording sheet is multi-fed in a preceding manner, according to a second exemplary embodiment.

FIG. 7A illustrates a state where an upper recording sheet P, which serves as a surface (hereinafter, referred to as a "printing surface" or an "image formation surface") on which an image is transferred from the secondary transfer section T2 illustrated in FIG. 1, is transported preceding to a lower recording sheet P.

Figure 7B:
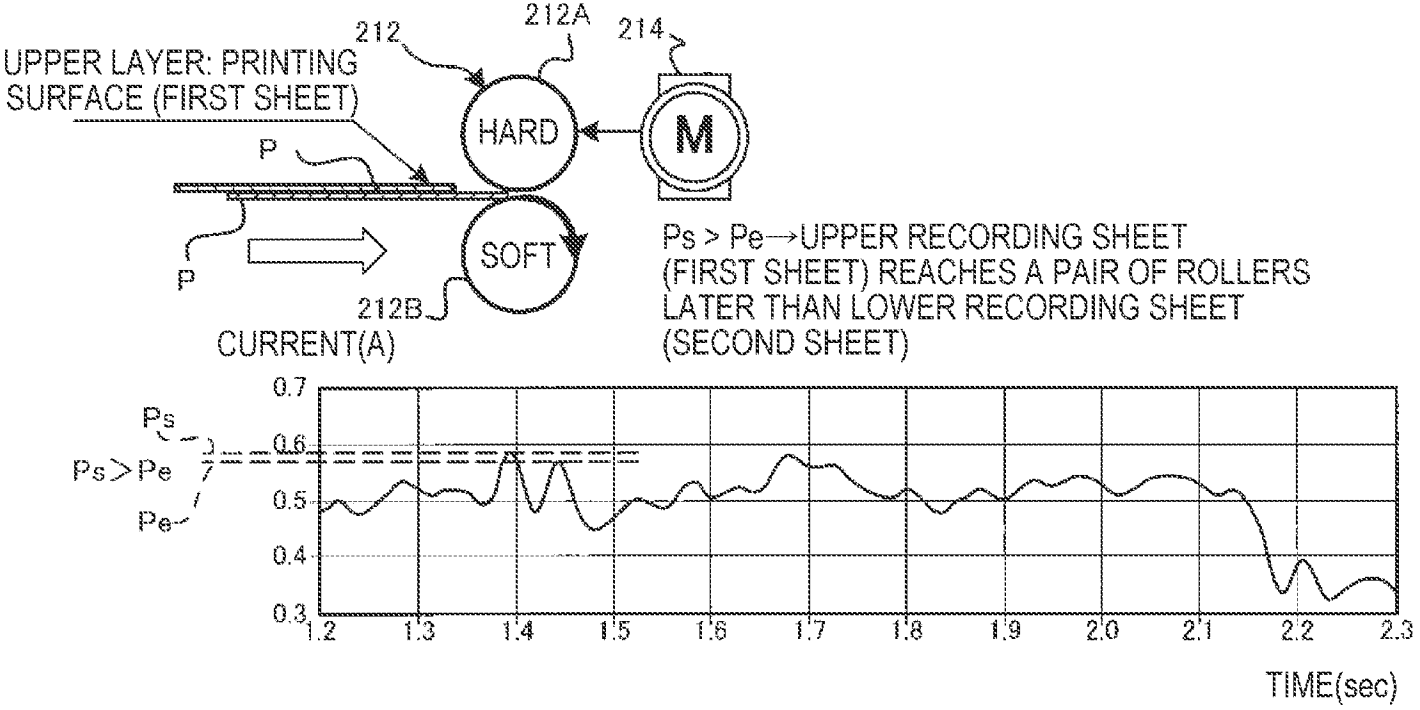
FIG. 7B illustrates a front view and a current characteristic diagram when a lower recording sheet is multi-fed in a preceding manner, according to the second exemplary embodiment.

FIG. 7B illustrates a state where a lower recording sheet P is transported preceding to an upper recording sheet P serving as a printing surface.

In any of the multi-feed states illustrated in FIGS. 7A and 7B, a load is applied to the motor 214 when the recording sheets P are pinched by the pair of rollers 212.

Accordingly, as in the first exemplary embodiment, the current (entry current) when the two recording sheets P enter the pair of rollers 212 has two peak waveforms.

Here, in the second exemplary embodiment, one roller 212A of the pair of rollers 212 illustrated in FIGS. 7A and 7B is made of a relatively hard material and the other roller 212B is made of a relatively soft material. Alternatively, one roller 212B may be made of a relatively hard material and the other roller 212A may be made of a relatively soft material.

Due to the difference in hardness between the pair of rollers 212, a balance in the heights (current values) of peak waveforms is reversed depending on whether the upper recording sheet P is preceding or the lower recording sheet. P is preceding.

As illustrated in FIG. 7A, when the upper recording sheet P is preceding, the peak value Ps of the upper recording sheet P is lower than the peak value Pe of the succeeding lower recording sheet P (Ps<Pe).

As illustrated in FIG. 7B, when the lower recording sheet P is preceding, the peak value Pe of the succeeding upper recording sheet P is lower than the peak value Ps of the lower recording sheet P (Ps>Pe).

In the second exemplary embodiment, the reversal of the balance between the peak value Ps and the peak value Pe is used to determine whether (i) the upper recording sheet P, which has the upper surface as a printing surface and is an original printing target recording sheet, is preceding or (ii) the lower recording sheet P, which is determined as an unnecessary recording sheet due to multi-feed, is preceding, and the transfer timing in the secondary transfer section T2 is adjusted (corrected).

Figure 8:
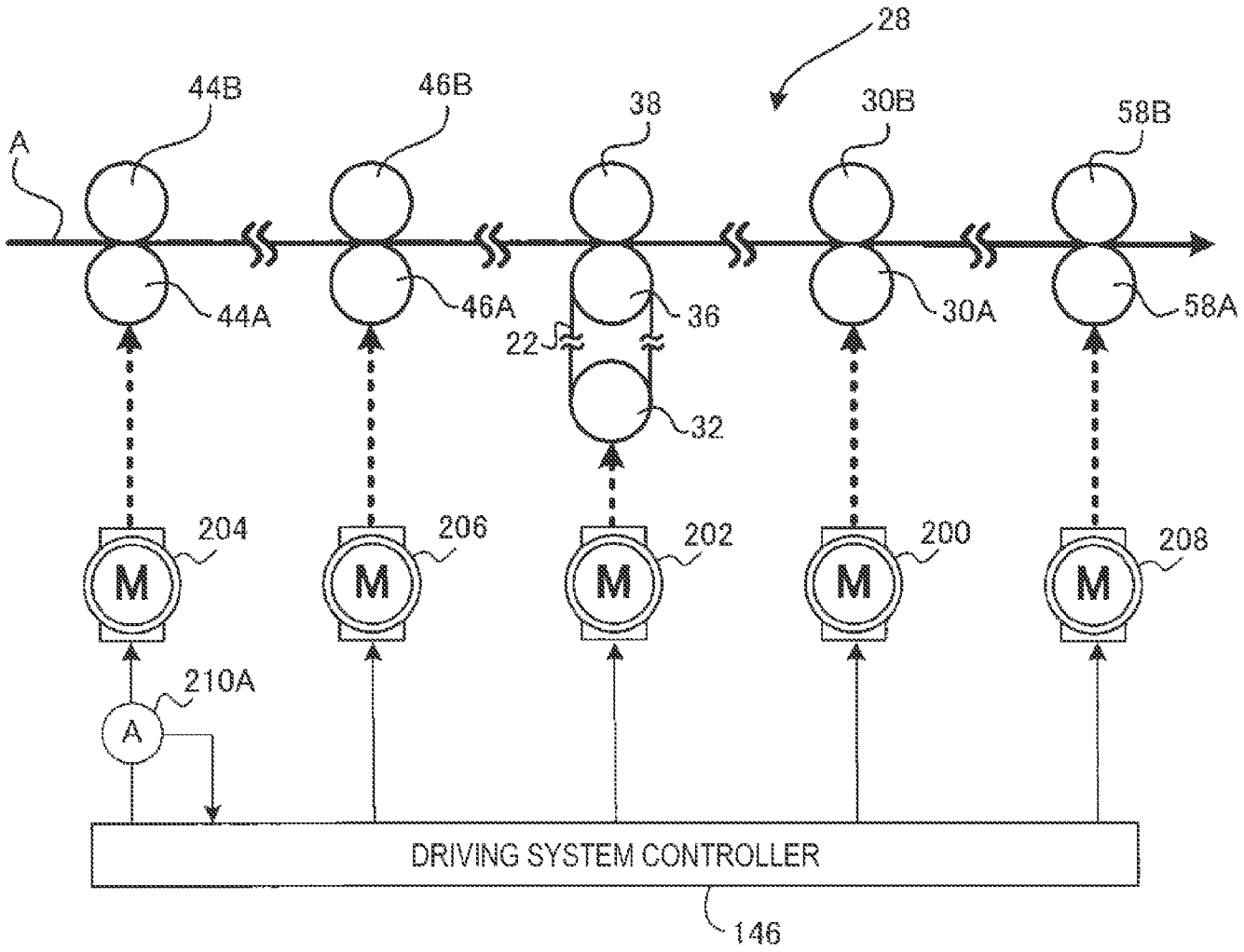
FIG. 8 is a front view equivalently illustrating a relative positional relationship between portions applying a transport force to a recording sheet in a recording sheet transport mechanism of the image forming apparatus in FIG. 1, according to the second exemplary embodiment.

In the second exemplary embodiment, since the adjustment of the transfer timing by the secondary transfer section T2 is mainly performed, the pair of rollers 212 to be monitored for multi-feed are limited to the feed rollers 44A. and 44B as illustrated in FIG. 8. Accordingly, a motor 214 equipped with the current detector 210 is limited to the feed motor 204.

That is, it is necessary to adjust the transport start timing of the recording sheet P toward the secondary transfer section T2 when the recording sheet P is nipped between the registration rollers 46A and 46B.

Figure 9:
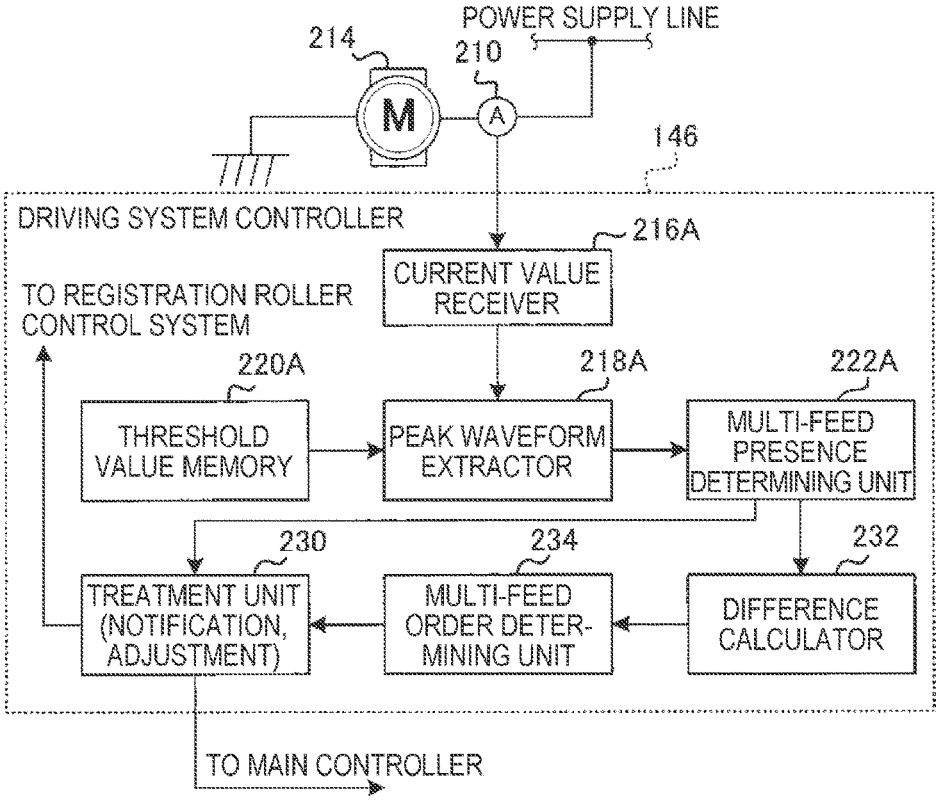
FIG. 9 is a block diagram specialized for a function executed by the driving system controller, that is, a function for executing monitoring of the multi-feed of a recording sheet P, according to the second exemplary embodiment.

FIG. 9 is a block diagram specialized for a function executed by the driving system controller 146, that is, a function for executing the monitoring of the multi-feed of the recording sheet P. It should be noted that the hardware configuration of the driving system controller 146 is not limited to the respective blocks of FIG. 9.

The multi-feed monitoring function may be executed by the image formation processing controller 144 or the main controller 120 illustrated in FIG. 2 regardless of the driving system controller 146. A dedicated control device having a multi-teed monitoring function may be newly mounted or connected to the image forming apparatus 10.

As illustrated in FIG. 9, the current detector 210 connected to the power supply line of the selected motor 214 (the feed motor 204 illustrated in FIG. 8) is connected to a current value receiver 216A.

The current value receiver 216A is connected to a peak waveform extractor 218A. The peak waveform extractor 218A is connected to a threshold value memory 220A.

The peak waveform extractor 218A specifies an entry current region (a peak waveform) exceeding a threshold value among the current values received by the current value receiver 216A.

The peak waveform extractor 218A is connected to a multi-feed presence determining unit 222A. The multi-feed presence determining unit 222A acquires information related to the peak waveform extracted by the peak waveform extractor 218 (a timing of a peak occurrence, etc.). The multi-feed presence determining unit 222A determines whether the multi-feed is present according to whether the number of peak waveforms (exceeding the threshold value) is singular or plural, based on the information related to the peak waveform.

That is, when the number of recording sheets P entering the pair of rollers 212 is one, the number of peak waveforms is one, and when the number of recording sheets P is two or more, the number of peak waveforms is two or more. Thus, when there one peak waveform, the multi-feed presence determining unit 222A determines that no multi-feed is present, and otherwise, the multi-feed presence determining unit 222A determines that multi-feed is present.

The result determined by the multi-feed presence determining unit 222A is sent to a treatment unit 230 and a difference calculator 232. The treatment unit 230 notifies a user of the occurrence of multi-feed at least when it is determined that the multi-feed is present. The notification maybe typically a notification made through visual sense such as warning display on the user interface 142, or turning-ON of light, or a notification made through auditory sense such as speaker output is representative. Alternatively, the notification may be made through other senses such as the sense of smell, the sense of touch, or the like.

The difference calculator 232 calculates a difference between peak values (here, it as assumed that two sheets are multi-fed). That is, as illustrated in FIGS. 7A and 7B, a difference between the peak value Ps of the preceding recording sheet P and the peak value Pe of the succeeding recording sheet P is calculated.

The difference calculator 232 is connected to multi-feed order determining unit 234, and sends the calculation result to the multi-feed order determining unit 234.

The multi-feed order determining unit 234 compares the peak value Ps to the peak value Pe (Ps:Pe).

When it is determined that Ps<Pe, the multi-feed order determining unit 234 determines that the upper recording sheet P preceding. When it is determined that Ps>Pe, the multi-feed order determining unit 234 determines that the lower recording sheet P is preceding.

The multi-feed order determining unit 234 is connected to the treatment unit 230, and sends the determination result. When Ps>Pe, the multi-feed order determining unit 234 sends the difference ΔP (=Ps−Pe).

The treatment unit 230 instructs the main controller 120 to make a notification through the user interface 142 or the like when multi-feed is present as described above, while instructing the main controller 120 to adjust a transfer timing in the secondary transfer section T2 in the case of the multi-feed in which the lower recording sheet P is preceding.

More specifically, just after the leading end of the recording sheet P is nipped between the registration rollers 46A and 46B, at a point of time when the leading end of the recording sheet P is detected, the registration rollers 46A and 46B are temporarily stopped, and the transfer timing of an image from the intermediate transfer belt 22 in the secondary transfer section T2 is adjusted.

In the case of the multi-feed in which the upper recording sheet P is preceding as illustrated in FIG. 7A, a position on the upper recording sheet P to which an image is transferred is not deviated in the transport direction. However, in the case where the lower recording sheet P is preceding as illustrated in FIG. 7B, the leading end is detected earlier. Thus, the timing of the image transfer to the upper recording sheet P comes earlier (the arrival of the upper recording sheet P is delayed) if no adjustment is made.

Therefore, the treatment unit 230 makes an instruction. such that transport to the secondary transfer section T2 is started with a delay time corresponding to the difference ΔP.

Hereinafter, the operation of the second exemplary embodiment will be described.

(Multi-Feed Monitoring Control)

Figure 10:
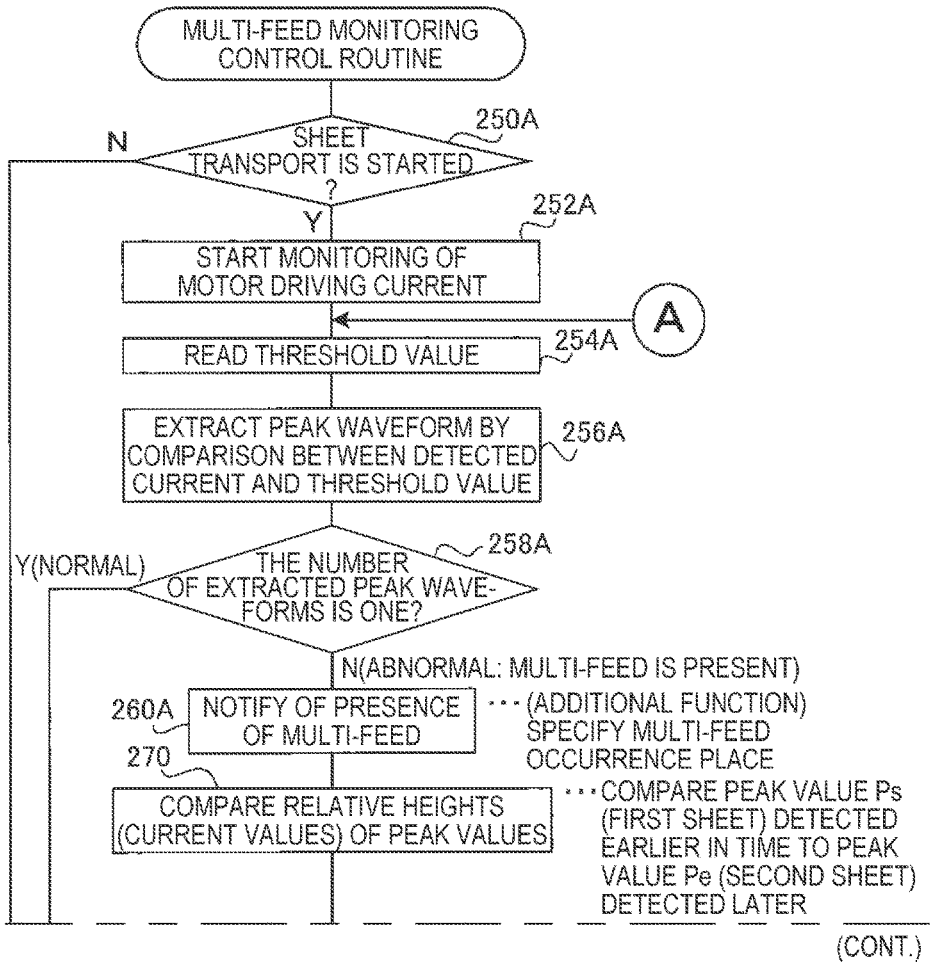
FIG. 10 is a flow chart illustrating a multi-feed monitoring control routine of a recording sheet P, which is executed by the driving system controller according to the second exemplary embodiment.

FIG. 10 is a flow chart illustrating a multi-feed monitoring control routine of a recording sheet P, which is executed by the driving system controller 146 according to the second exemplary embodiment.

In step 250A, it is determined whether the transport of the recording sheet 2 is started. When a negative determination is made, this routine is ended.

When an affirmative determination is made in step 250A, the process proceeds to step 252A to start the monitoring of a motor driving current.

Thereafter, in step 254A, a threshold value is read, and the process proceeds to step 256A so that a peak waveform that is a load current (entry current) when the recording sheet P enters the pair of rollers 212 is extracted by comparing a current value detected by the current detector 210 to the threshold value.

Next, in step 258A, it is determined whether the number of peak waveforms extracted in step 256A is one. When an affirmative determination is made, it is determined that no multi-feed is present (normal), and the process proceeds to step 262A.

When a negative determination is made in step 258A, it is determined that multi-feed is present (abnormal), and the process proceeds to step 260A. A fact of multi-feed is notified and the process proceeds to step 270.

In step 270, the relative heights (current values) of peak values are compared. That is, a peak value Ps (first sheet) detected earlier in time and a peak value Pe (second sheet) detected later are compared.

Next, in step 272, through the result of comparison in step 270, it is determined whether Ps>Pe.

When a negative determination (Ps≤Pe) is made in step 272, it is determined that the upper recording sheet P, which serves as a printing surface, is preceding (earlier), and the adjustment of transfer timing is unnecessary in step 274. The process proceeds to step 262A. The equal sign (=) maybe added to either (<) or (>). As a result, since ΔP is 0, there is no problem in terms of control.

Meanwhile, when an affirmative determination (Ps>Pe) is made in step 272, it is determined that the upper recording sheet P, which serves as a printing surface, is succeeding (later), and the adjustment of transfer timing is necessary in step 276. The process proceeds to step 278.

In step 278, an instruction of a delay of a transfer start position is made corresponding to a time obtained by a difference ΔP (=Ps=Pe) of peak values, and a transport speed of the recording sheet P, and the process proceeds to step 262A.

FIG. 11A is a plan view illustrating a transfer state on a recording sheet P in a case where no multi-feed is present. For example, when a transfer image is a letter "A," the image is transferred to a proper position.

Figure 11B:
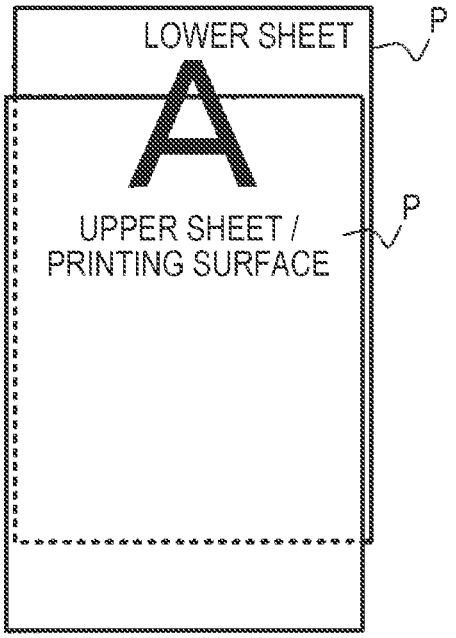
FIG. 11B is a plan view illustrating an image transfer state on a recording sheet in a case where multi-feed is present but no transfer timing adjustment is performed, according to the second exemplary embodiment.

In contrast, when delay processing is not performed even through it is determined that the transfer timing adjustment is necessary, the letter "A" is transferred in accordance with the transport state of the lower recording sheet P as illustrated in FIG. 11B, and as a result, the transfer timing to the upper recording sheet P is inappropriate.

Figure 11C:
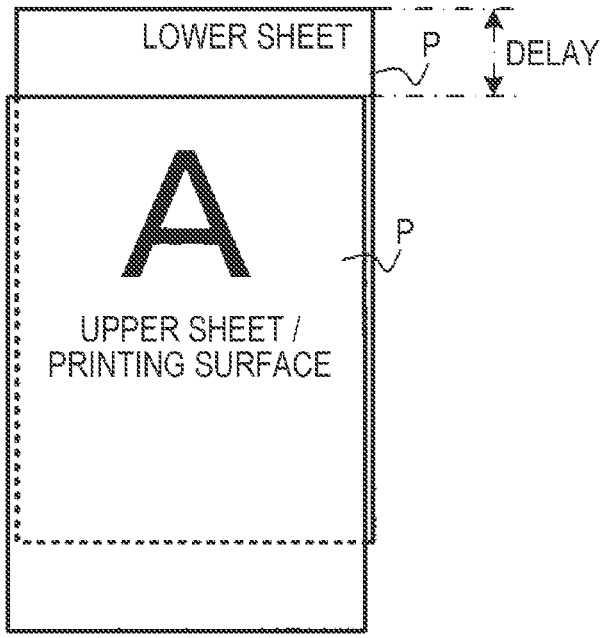
FIG. 11C is a plan view illustrating an image transfer state on a recording sheet in a case where multi-feed present and a transfer timing adjustment is performed, according to the second exemplary embodiment.

Therefore, as illustrated in FIG. 11C, the transfer time of the letter "A" is delayed by the time corresponding to the length L according to a difference ΔP between the upper recording sheet P and the lower recording sheet P. Accordingly, it is possible to transfer the image at the proper position. on the upper recording sheet P.

In step 262A, it is determined whether the transport of the recording sheet P is ended (whether the image formation processing is ended). When a negative determination is made, the process proceeds back to step 254A and the above described steps are repeated.

When an affirmative determination is made in step 262A, the process proceeds to step 264A. The monitoring of the motor driving current is ended and this routine is ended.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport monitoring control device comprising:

a pair of rollers configured to transport a recording medium while nipping the recording medium therebetween, the pair of rollers having circumferential surfaces coming in contact with the recording medium, the circumferential surfaces being different from each other in hardness;

a motor configured to drive the pair of rollers; and at least one hardware processor configured to implement:

a detector configured to detect waveforms related to a driving current of the motor;

an extractor configured to extract a peak waveform having an extreme point temporarily exceeding a predetermined threshold value, from among the waveforms detected by the detector; and a determining unit configured to determine whether multi-feed of the recording medium is present, based on a number of peak waveforms extracted by the extractor, wherein the peak waveforms are electrical-current peak waveforms.

2. The transport monitoring control device according to claim 1, wherein the peak waveforms are waveforms indicating a change in thickness in a case in which a leading end of the recording medium is nipped and depend on a rotational resistance force of a first of the circumferential surfaces which is softer than a second of the circumferential surfaces.

3. The transport monitoring control device according to claim 2, wherein the at least one hardware processor is further configured to implement:

a notifying unit configured to notify of a result determined by the determining unit.

4. The transport monitoring control device according to claim 1, wherein the at least one hardware processor is further configured to implement:

a notifying unit configured to notify of a result determined by the determining unit.

5. The transport monitoring control device according to claim 1, wherein the at least one hardware processor is further configured to implement:

a specifying unit configured to specify a preceding recording medium by comparing extreme points of two or more peak waveforms in a case in which the determining unit determines that the number of peak waveforms is plural and that multi-feed is present; and a correcting unit configured to correct a defect in post-processing caused by a deviation, in a transport direction, of the recording medium specified by the specifying unit.

6. The transport monitoring control device according to claim 1, wherein the determining unit is further configured, in a case in which the multi-feed of the recording medium is present, to determine whether a first sheet, of a plurality of sheets of the recording medium, which reached the pair of rollers before a second sheet, of the plurality of sheets, overlaps the second sheet by determining which of the electrical-current peak waveforms is larger such that an overlap of the first sheet over the second sheet comprises the first sheet being closer than the second sheet, while both the first sheet and the second sheet are between the pair of rollers, to one of the circumferential surfaces, being harder than another of the circumferential surfaces, than to the another of the circumferential surfaces.

7. The transport monitoring control device according to claim 6, wherein the determining unit is further configured, in the case in which the multi-feed of the recording medium is present, to determine that the first sheet overlaps the second sheet in a case in which it is determined that a first electrical-current peak waveform, corresponding to a first of the peak waveforms occurring from the first sheet entering between the pair of rollers, is less than a second of the peak waveforms occurring from the second sheet entering between the pair of rollers while the first sheet is also between the pair of rollers.

8. The transport monitoring control device according to claim 6, wherein the determining unit is further configured, in the case in which the multi-feed of the recording medium is present, to determine that the first sheet is overlapped by the second sheet in a case in which it is determined that a first electrical-current peak waveform, corresponding to a first of the peak waveforms occurring from the first sheet entering between the pair of rollers, is greater than a second of the peak waveforms occurring from the second sheet entering between the pair of rollers while the first sheet is also between the pair of rollers.

9. The transport monitoring control device according to claim 8, wherein the at least one hardware processor is further configured to, in a case in which it is determined by the determining unit that the second sheet overlaps the first sheet, implement:

a transfer member configured to transfer an image to the recording medium; and delaying transport of the first sheet and the second sheet until a timing-delay, corresponding to a time indicated between the first and the second of the peak waveforms, is applied to a time at which the transfer member was predetermined to transfer the image prior to detection of the second of the peak waveforms.

10. An image forming apparatus comprising:

a transport unit configured to transport a recording medium, which is taken out from an accommodating unit, along a preset transport path while the recording medium is nipped by a plurality of pairs of rollers each of which is driven by a driving force of a motor;

a transfer member serving as one of the plurality of pairs of rollers in the transport unit, wherein in a case in which facing the recording medium being transported, the transfer member transfers an image at a position where the transfer member faces the recording medium; and at least one hardware processor configured to implement:

a detector configured to detect a waveform related to a driving current of the motor for a pair of rollers disposed upstream of the transfer member;

an extractor configured to extract a peak waveform having an extreme point temporarily exceeding a predetermined threshold value, from among waveforms detected by the detector;

a determining unit configured to determine whether multi-feed of the recording medium is present, based on a number of peak waveforms extracted by the extractor;

a specifying unit configured to specify a preceding recording medium by comparing extreme points of two or more peak waveforms in a case in which the determining unit determines that the number of peak waveforms is plural and that the multi-feed is present; and a delaying unit configured to delay a transfer timing using a difference between (i) an extreme point of a peak waveform indicating that a leading end of the preceding recording medium specified by the specifying unit enters and (ii) an extreme point of a peak waveform indicating that a leading end of a recording medium to which the image is to be transferred enters, wherein the two or more peak waveforms are two or more electrical-current peak waveforms.

* * * * *